US010472781B2

(12) United States Patent
Uezu

(10) Patent No.: US 10,472,781 B2
(45) Date of Patent: Nov. 12, 2019

(54) ANCHOR PILE AND INSTALLATION METHOD FOR SAME

(71) Applicant: TACHIGAMI IRON WORKS CO., LTD., Okinawa (JP)

(72) Inventor: Masanao Uezu, Okinawa (JP)

(73) Assignee: TACHIGAMI IRON WORKS CO., LTD., Okinawa (JP)

( * ) Notice: Subject to any disclaimer, the term of this patent is extended or adjusted under 35 U.S.C. 154(b) by 67 days.

(21) Appl. No.: 15/571,435

(22) PCT Filed: Jan. 15, 2016

(86) PCT No.: PCT/JP2016/051178

§ 371 (c)(1),
(2) Date: Nov. 2, 2017

(87) PCT Pub. No.: WO2016/189887

PCT Pub. Date: Dec. 1, 2016

(65) Prior Publication Data

US 2019/0153684 A1 May 23, 2019

(30) Foreign Application Priority Data

May 26, 2015 (JP) ..... 2015-106545

(51) Int. Cl.
*E02D 5/54* (2006.01)
*E01F 9/685* (2016.01)
(Continued)

(52) U.S. Cl.
CPC ..... *E01F 9/685* (2016.02); *E02D 5/54* (2013.01); *E02D 5/56* (2013.01); *E02D 5/805* (2013.01);
(Continued)

(58) Field of Classification Search
CPC .. E02D 5/805; E02D 5/56; E02D 5/54; E02D 2600/30; E01F 9/685; E04H 12/223
See application file for complete search history.

(56) References Cited

U.S. PATENT DOCUMENTS 958,127 A * 5/1910 Hovrud ..... E02D 5/803 411/21
2,396,276 A * 3/1946 Lang ..... E02D 5/805 411/470
(Continued)

FOREIGN PATENT DOCUMENTS

GB 2546203 A * 7/2017 ..... E02D 5/803
JP 04-166511 A 6/1992
(Continued)

*Primary Examiner* — Adriana Figueroa
(74) *Attorney, Agent, or Firm* — Heedong Chae; Lucem, PC

(57) ABSTRACT

The present invention provides an anchor pile and installation method for the same, which includes insertion hole portions and guide portions formed in the side surface of a hollow pipe. In a state where a resistance member formed of a material that can be elastically deformed is stored within the pipe, the anchor pile is driven into the ground. When an auxiliary tool is used to pull up the resistance member in a vertical direction within the pipe after the anchor pile is driven into the ground, the protrusion portions of the resistance member slide on the guide portions and are deformed so as to be opened and extended toward the insertion hole portions. The protrusion portions of the resistance member are protruded from the insertion hole portions toward the ground and function to provide the resistance force of the anchor pile in the ground.

4 Claims, 11 Drawing Sheets

(51) Int. Cl.
*E02D 5/80* (2006.01)
*E04H 12/22* (2006.01)
*E02D 5/56* (2006.01)

(52) U.S. Cl.
CPC ..... *E04H 12/223* (2013.01); *E02D 2600/30* (2013.01)

(56) References Cited

U.S. PATENT DOCUMENTS

| | | | | | |
|---|---|---|---|---|---|
| 3,526,069 | A * | 9/1970 | Deike | E02D 5/805 | 405/244 |
| 3,680,274 | A * | 8/1972 | Deike | E02D 5/801 | 405/237 |
| 5,010,698 | A * | 4/1991 | Hugron | E02D 5/805 | 135/118 |
| 5,217,194 | A * | 6/1993 | Brownell | A63G 9/00 | 135/118 |
| 5,702,215 | A * | 12/1997 | Li | F16B 13/0866 | 411/21 |
| 7,497,053 | B2 * | 3/2009 | Nicolet | E02D 5/74 | 248/545 |
| 2002/0014570 | A1 * | 2/2002 | Jenny | E02D 5/801 | 248/545 |

FOREIGN PATENT DOCUMENTS

| | | | | |
|---|---|---|---|---|
| JP | 10-183617 | A | 7/1998 | |
| JP | 2005-023620 | A | 1/2005 | |
| WO | WO-0142569 | A1 * | 6/2001 | E02D 5/80 |

* cited by examiner

-- Prior Art --

ANCHOR PILE AND INSTALLATION METHOD FOR SAME

CROSS-REFERENCE TO RELATED APPLICATION

This application claims the benefit of Japanese Application No. 2015-106545 filed on May 26, 2015 with the Japan Patent Office, the disclosure of which is incorporated herein by reference.

TECHNICAL FIELD

The present invention relates to an anchor pile and a method for installing the anchor pile. More specifically, the present invention relates to an anchor pile and a method for installing the anchor pile to obtain a stable resistance force in the ground while the anchor pile is easily installed.

BACKGROUND ART

In general, when ground members and devices, such as a sign, a guardrail and a solar panel, are fixed to the ground such as soil or concrete, anchor piles are embedded to enhance a resistance force in the ground, and thus a support force is strengthened In particular, in mega-solar power plants which have seen extensive growth in construction due to the promotion of the utilization of renewable energy in Japan in recent years, a large number of solar panels may be installed on a vast tract of land which is significantly affected by the natural environment (which is particularly affected by wind). There are also concerns that the solar panel installed under such environment is affected by, for example, wind blown up from the ground surface so as to be floated up as a whole, and that when a resistance force of the anchor pile in the ground is weak, the solar panel may be blown away in the worst case, which leads to a major accident. Hence, high expectations are placed on technology development for enhancing the resistance force of the anchor pile in the ground.

Conventionally, for an anchor pile embedded in the ground, a steel pipe has been generally used, and in order to enhance a resistance force in the ground, for example, the diameter of the pipe has been increased.

For example, Patent Literature 1 discloses an anchor pile in which a predetermined resistance member is formed around a pipe to enhance a resistance force in the ground.

Specifically, as shown in FIG. 11, on the side surface of a pipe 102, a spiral member 103 is formed in a spiral shape. In order for an anchor pile 101 described above to be embedded in the ground, the anchor pile 101 is driven while the entire anchor pile 101 is being rotated, and thus the anchor pile 101 enters the ground while a cutting teeth 104 at a tip end is breaking up soil. Here, the spiral member 103 serves as a guide when the pipe 102 is rotated and pressurized to be embedded in the ground. Furthermore, after the anchor pile 101 is driven into the ground, the spiral member 103 serves to provide a resistance force in the ground so that the anchor pile 101 can be held in a stable state see (Patent Literature 1).

CITATION LIST

Patent Literature

Patent Literature 1: Japanese Unexamined Patent Application Publication No. H10-183617

SUMMARY OF INVENTION

Technical Problem

However, in Patent Literature 1, since the width of protrusion of the spiral member of the anchor pile is short, though an entrance resistance force when the operation of driving the anchor pile is performed and an exit resistance force when the operation of pulling out the anchor pile from the ground is performed can be reduced, the resistance force in the ground after the anchor pile is installed in the ground is low and is unlikely to be stable.

On the other hand, when the width of protrusion of the spiral member is increased, though the resistance force in the ground after the anchor pile is installed in the ground is increased so as to become stable, the entrance resistance force when the operation of driving the anchor pile is performed and the exit resistance force when the operation of pulling out. the anchor pile is performed are increased, with the result that it disadvantageously takes much time to perform each operation.

The present invention is made in view of the foregoing points, and has an object to provide an anchor pile and a method of installing such the anchor pile in which the anchor pile is easily installed and in which it is possible to obtain a stable resistance force in the ground.

Solution to Problem

In order to achieve the above object, an anchor pile according to the present invention includes: a hollow pipe in which at least two predetermined insertion hole portions are formed in a side surface; a resistance member which includes at least two protrusion portions and which is stored so as to be able to be moved within the pipe by application of a predetermined external force with an auxiliary tool that can perform a push-pull operation; and a guide portion which guides the protrusion portion of the resistance member such that the protrusion portion is protruded from the insertion hole portion to the outside of the pipe, where the guide portion is a region in which the outer circumference of the pipe is recessed inward in a state where a slit is formed in the side surface of the pipe, and a tip end portion of the guide portion and an edge end portion formed by the slit and located in the outer circumference of the pipe are located substantially on the same straight line when seen in a direction substantially perpendicular to the axial direction of the pipe.

Here, the pipe is hollow, and thus it is possible to store the resistance member into the pipe. Hence, when the anchor pile is driven into the ground, the resistance member is stored into the pipe, and thus it is possible to reduce an entrance resistance force when the operation of driving the anchor pile is performed, with the result that the driving operation is easily performed.

Furthermore, after the anchor pile is driven into the ground, the resistance member can also be inserted and stored into the pipe. Hence, when the anchor pile is driven into the ground, the resistance member is not present within the pipe, and thus it is possible to reduce the entrance resistance force when the driving operation is performed, with the result that the operation of driving the anchor pile into the ground is easily performed.

When the anchor pile is pulled out from the ground, the resistance member is stored into the pipe, and thus it is possible to reduce an exit resistance force when the operation of pulling out the anchor pile is performed, with the result that the pull-out operation is easily performed.

The predetermined insertion hole portions are formed in the side surface of the hollow pipe, and thus after the anchor pile is installed in the ground, the resistance member stored within the pipe can be protruded from the insertion hole portions into the ground, with the result that the stability of the anchor pile in the ground is enhanced.

At least two insertion hole portions are formed, and thus the resistance member can be protruded into the ground from at least two different directions, with the result that the stability of the anchor pile in the ground is further enhanced.

The auxiliary tool which can perform the push-pull operation is provided, and thus the resistance member stored within the pipe can be pulled up or pushed down with the auxiliary tool. Hence, with the simple push-pull operation, it is possible to protrude the protrusion portions from the interior of the pipe toward the ground or to store, into the pipe, the resistance member protruded into the ground.

Since at least two protrusion portions which are parts of the resistance member are put in through the insertion hole portions formed in the side surface of the pipe, and are protruded from the interior of the pipe into the ground, the stability of the anchor pile in the ground is enhanced with a simple configuration. Furthermore, at least two protrusion portions are provided, and thus a plurality of protrusion portions can be protruded into the ground in different directions, with the result that the stability of the anchor pile in the ground is further enhanced.

At predetermined locations around the insertion hole portions, the guide portions are provided to guide the protrusion portions to the insertion hole portions, and thus the protrusion portions can be reliably protruded into the ground. Furthermore, rigidity around the insertion hole portions is enhanced by the guide portions, and thus it is possible to prevent the insertion hole portions from being deformed and degraded.

Since the guide portion is the region in which the outer circumference of the pipe is recessed inward in the state where the slit is formed in the side surface of the pipe, the slit formed in the side surface of the pipe can be easily formed into the guide portion by press processing. Furthermore, since the guide portion is molded integrally with the pipe, even when the sliding operation of the protrusion portion is repeatedly performed, the guide portion is prevented from being disconnected.

The tip end portion of the guide portion and the edge end portion formed by the slit and located in the outer circumference of the pipe are located substantially on the same straight line when seen in the direction substantially perpendicular to the axial direction of the pipe, and thus the protrusion portion of the resistance member protruded from the interior of the pipe toward the ground is securely held by the tip end portion of the guide portion and the edge end portion located in the outer circumference of the pipe, with the result that the resistance force of the protrusion portions in the ground can be sufficiently achieved.

When the angle at which the protrusion portion abuts on the guide portion is an acute angle, the protrusion portion abutting on the guide portion can be reliably guided to the insertion hole portion. Hence, it is possible to further reliably protrude the protrusion portions into the ground.

When within the pipe, in a position in which the resistance member is stored, a stopper portion is provided that holds the resistance member, the resistance member can be securely held within the pipe. Hence, when the anchor pile is driven into the ground in a state where the resistance member is stored within the pipe and when the anchor pile is pulled out from the ground, the resistance member is prevented from being moved within the pipe and is prevented from being moved out to the outside of the pipe.

Furthermore, even when the resistance member is smaller than the diameter of the pipe on the insertion end side where the resistance member is inserted, the resistance member can be held by the stopper portion. Hence, even after the anchor pile is driven into the ground, the resistance member can be inserted into the pipe from the insertion end side of the pipe. Thus, before and after the anchor pile is driven into the ground, the resistance member can be stored into the pipe, with the result that flexibility in the installation of the resistance member is increased.

When the pipe has a tapered portion in which the outer diameter of the pipe is tapered toward one end side that is driven into the ground, the entrance resistance force when the anchor pile is driven into the ground is reduced, with the result that the driving operation is easily performed.

Since the resistance member can be securely held by the tapered portion of the pipe, when, in the state where the resistance member is stored within the pipe, the anchor pile is driven into the ground and when the anchor pile is pulled out from the ground, the resistance member is prevented from being moved within the pipe and is prevented from being moved out to the outside of the pipe.

Advantageous Effects of Invention

In the anchor pile and the method of installing it according to the present invention, it is possible to obtain a stable resistance force in the ground while the anchor pile is easily installed.

DESCRIPTION OF EMBODIMENTS

Figure 1:
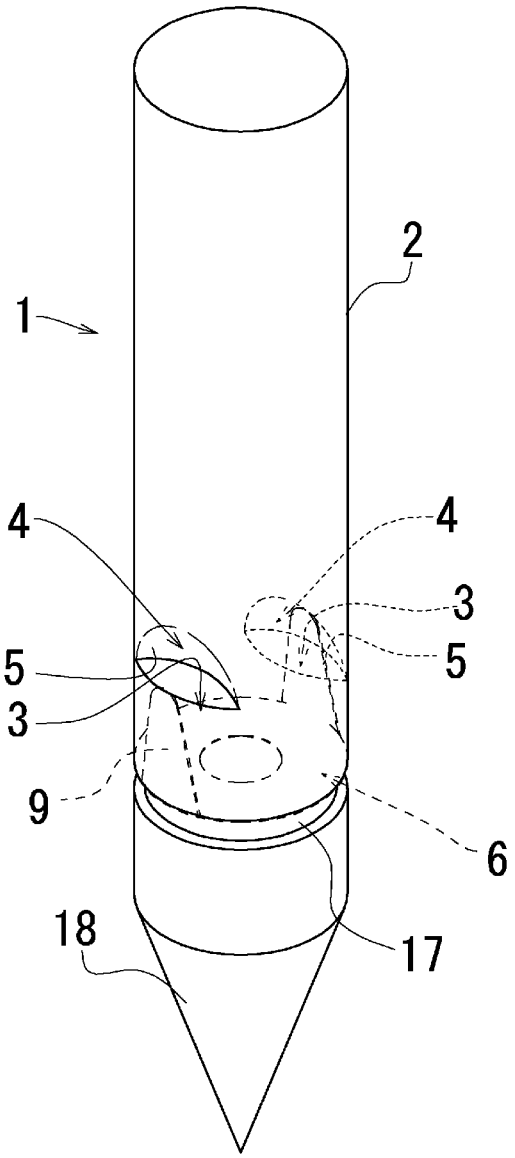
FIG. 1 is a perspective view of an anchor pile according to a first embodiment of the present invention.

Embodiments of the present invention on an anchor pile and a method of installing it will be described below with reference to drawings for understanding of the present invention.

First, an overall configuration of an anchor pile 1 according to a first embodiment to which the present invention is applied will be described with reference to FIG. 1. In the anchor pile 1, a resistance member 6 which functions to provide a resistance force in the ground is stored in a hollow pipe 2.

A ground excavation blade 18 is attached to the tip end of the pipe 2. In the side surface of the pipe 2, an insertion hole portion 3 through which a protrusion portion 9 of the resistance member 6 is inserted, and a guide portion 5 are formed.

Furthermore, in the side of the pipe 2, a stopper portion 17 for holding the resistance member 6 within the pipe 2 is formed.

The insertion hole portion 3 and the guide portion 5 are formed in at least two locations, for example, in positions which are at about 180 degrees to each other about the center of the center axis of the pipe 2.

The insertion hole portion 3 is formed by providing a slit in the side surface of the pipe 2 and recessing part thereof toward the inside of the pipe 2 by a known processing method such as press processing. A concave portion 4 which is a region obtained by recessing the side surface of the pipe functions as the guide portion 5.

Here, since the tip end portion of the guide portion 5 and an edge end portion which is formed by the slit and located in the outer circumference of the pipe 2 are formed to be located on the same straight line when the side surface is seen vertically with respect to the direction of the axis of the pipe 2, the protrusion portion 9 of the resistance member 6 which is protruded from the pipe 2 toward the ground is securely held by the tip end portion of the guide portion 5 and the edge end portion located in the outer circumference of the pipe 2.

The ground excavation blade 18 can be removed, and has a tapered shape on the one end side which is driven into the ground and is tapered, and the tip end portion is driven ahead in the ground entrance direction.

Here, the pipe 2 does not always need to be formed in the shape of a cylinder as shown in FIG. 1. The pipe 2 may be formed in the shape of, for example, a prism such as a quadrangular prism or a hexagonal prism.

The insertion hole portion 3 and the guide portion 5 do not always need to be formed at two locations on the side surface of the pipe 2, and may be formed at three or more locations.

Moreover, the insertion hole portion 3 and the guide portion 5 do not always need to be formed in positions which are about 180 degrees to each other about the center of the center axis. For example, they can also be formed in positions which are about 100 degrees or 120 degrees to each other.

Moreover, the insertion hole portion 3 does not always need to be formed by providing the silt in the side surface of the pipe 2 and recessing part thereof toward the inside of the pipe 2. For example, in the side surface of the pipe 2, an opening portion may be formed that has a predetermined shape through which part of the resistance member 6 to be described later can be inserted.

In this case, the guide portion 5 which is formed separately is preferably attached around the opening portion. However, by providing the slit in the side surface of the pipe 2 and recessing part thereof toward the inside of the pipe 2, with simple press processing, the insertion hole portion 3 and the guide portion 5 are formed simultaneously. The guide portion 5 is formed integrally with the pipe 2, and thus it is not necessary to perform an operation of attaching the guide portion 5 to the pipe 2, and the guide portion 5 is also prevented from being removed. Furthermore, the amount of protrusion of the guide portion 5 toward the inside of the pipe 2 can easily be changed by the amount of recessing by the pressing.

Moreover, the ground excavation blade 18 does not always need to be attached. However, the ground excavation blade 18 is attached, and thus it is possible to locate the anchor pile 1 with respect to the ground when the operation of driving the anchor pile 1 is performed and to assist the straight-in approach, with the result that the driving operation is easily performed.

Next, the resistance member 6 will be described with reference to FIG. 2. The resistance member 6 is mainly formed of metal and functions to provide the resistance force of the anchor pile 1 in the ground. In the basic structure of the resistance member 6, the two protrusion portions 9 which can be inserted through the insertion hole portions 3 are continuously connected to a substantially circular base portion 7. In the center portion of the base portion 7, a coupling portion 8 is formed and couples an auxiliary tool 10 with which an operation of pushing and pulling the resistance member 6 is performed within the pipe which will be described later.

Here, the number of protrusion portions 9 does not always need to be two, and the protrusion portions 9 are provided according to the number of insertion hole portions 3. For example, when four insertion hole portions 3 are formed in the side surface of the pipe 2, four protrusion portions 9 are continuously connected to the base portion 7 at maximum.

Moreover, the length of the protrusion portion 9 is not always uniformly determined, and is selected as necessary according to the condition of the ground and an environment in which the anchor pile 1 is installed. For example, when the anchor pile 1 is installed in a relatively hard ground or when the anchor pile 1 is installed under an environment that is not affected by wind, the resistance member 6 having the protrusion portion 9 whose length is short is selected. On the other hand, when the anchor pile 1 is installed in a relatively soft ground or when the anchor pile 1 is installed under an environment that is significantly affected by wind, the resistance member 6 having the protrusion portion 9 whose length is long is selected.

Moreover, the resistance member 6 does not always need to include the base portion 7. For example, the resistance member 6 may be formed by connecting together one end of the protrusion portions 9 such that its cross section is substantially formed in the shape of the letter V. However, the resistance member 6 includes the base portion 7, and thus the rigidity of the resistance member 6 is enhanced, with the result that it is possible to repeatedly use the resistance member.

Moreover, the base portion 7 does not always need to be formed substantially in the shape of a circle. For example, the base portion 7 may be formed in the shape of a square, a rectangle or an oval, and the shape of the base portion 7 is selected as necessary so as to correspond to the cross-sectional shape of the pipe 2.

Figure 2:
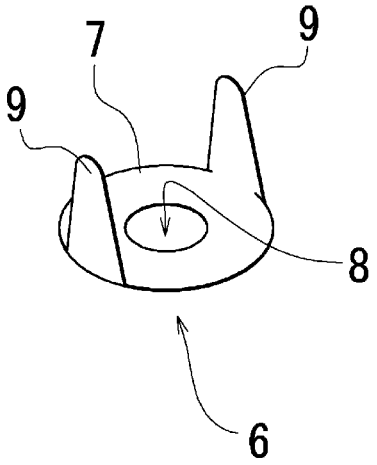
FIG. 2 is a perspective view of a resistance member.

Moreover, the coupling portion 8 does not always need to be a circular hole as shown in FIG. 2, and the shape of the coupling portion 8 is selected as necessary according to the auxiliary tool 10 that is used. For example, the coupling portion 8 may be formed in the shape of a hook in which the auxiliary tool 10 is caught.

Next, the change from a state where the resistance member 6 is stored in the pipe 2 to a state where the protrusion portions 9 are protruded to the outside of the pipe 2 will be described with reference to FIGS. 3 to 6.

Figure 3:
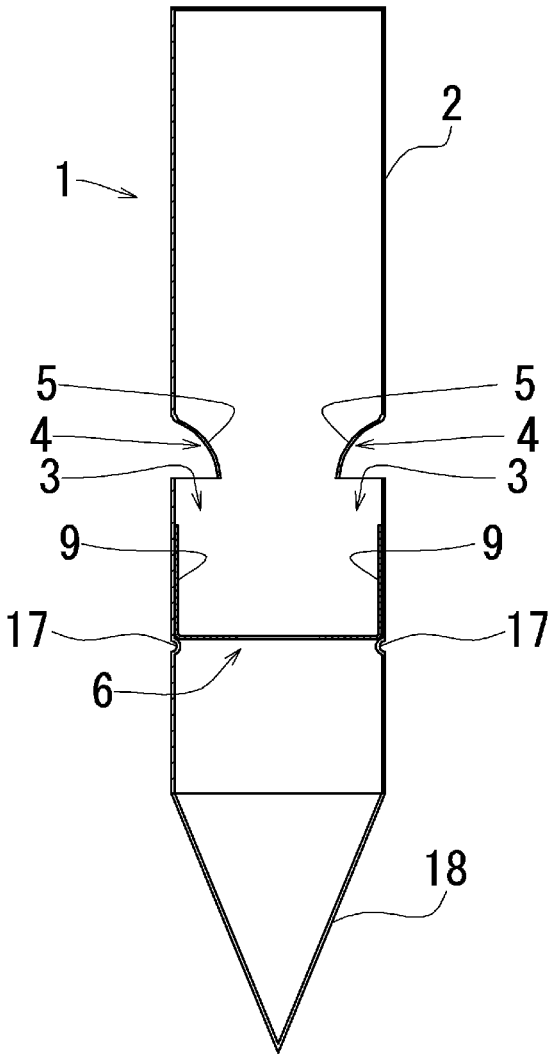
FIG. 3 is a cross-sectional view showing a state where the resistance member is stored within a pipe.

As shown in FIG. 3, the resistance member 6 is stored within the pipe 2 below the insertion hole portions 3 and the protrusion portions 5 in a vertical direction in a state where its cross section is formed substantially in the shape of the letter U to be supported by the stopper portion 17. The stopper portion 17 is formed by recessing the side surface of the pipe 2 along the circumferential direction thereof toward the inside of the pipe. The protrusion portions 9 of the resistance member 6 are formed of a material that can be elastically deformed in the direction in which they are moved away from each other, and are fixed to the inner circumferential surface of the pipe 2 such that the protrusion portions 9 can make slidable contact therewith.

Here, the stopper portion 17 does not always need to be formed by recessing the side surface of the pipe 2 along the circumferential direction toward the inside of the pipe 2. For example, the stopper portion 17 may be formed by recessing part of the side surface of the pipe 2 toward the inside of the pipe 2.

The stopper portion may be formed separately and attached to the inner surface of the pipe 2. However, the side surface of the pipe 2 is recessed, and with simple press processing, it is possible to form the stopper portion 17. Since the stopper portion 17 is formed integrally with the pipe 2, it is not necessary to perform the operation of attaching the stopper portion 17 to the pipe 2, and the stopper portion 17 is prevented from being removed. Furthermore, the amount of protrusion of the stopper portion 17 toward the inside of the pipe 2 can be easily changed by the amount of recessing by the pressing.

Moreover, the protrusion portion 9 does not always need to be formed of the material that can be elastically deformed. As long as the protrusion portion 9 is deformed to be opened and extended in the direction in which they are moved away from each other, for example, the thickness of the protrusion portion 9 may be decreased such that the protrusion portion 9 is easily deformed so as to be opened and extended or the protrusion portion 9 may be formed of a material that can be plastically deformed.

However, the protrusion portion 9 is formed of the material that can be elastically deformed in the direction in which they are moved away from each other, and thus in a state where the resistance member 6 is stored in the pipe, the protrusion portion 9 presses the inner circumference of the pipe 2, with the result that the resistance member 6 can be securely held within the pipe 2. Hence, when the operation of driving the anchor pile 1 into the ground is performed and when the operation of pulling out the anchor pile 1 from the ground is performed, the resistance member 6 is prevented from being moved within the pipe and is prevented from being moved out of the pipe 2, and thus each operation is easily performed.

Moreover, the entire protrusion portion 9 of the resistance member 6 does not always need to make contact with the inner circumferential surface of the pipe 2. For example, only the tip end portion of the protrusion portion 9 or only the portion in which the protrusion portion 9 and the base portion 7 are continuously connected to each other preferably makes contact with the inner circumferential surface of the pipe 2.

Figure 4:
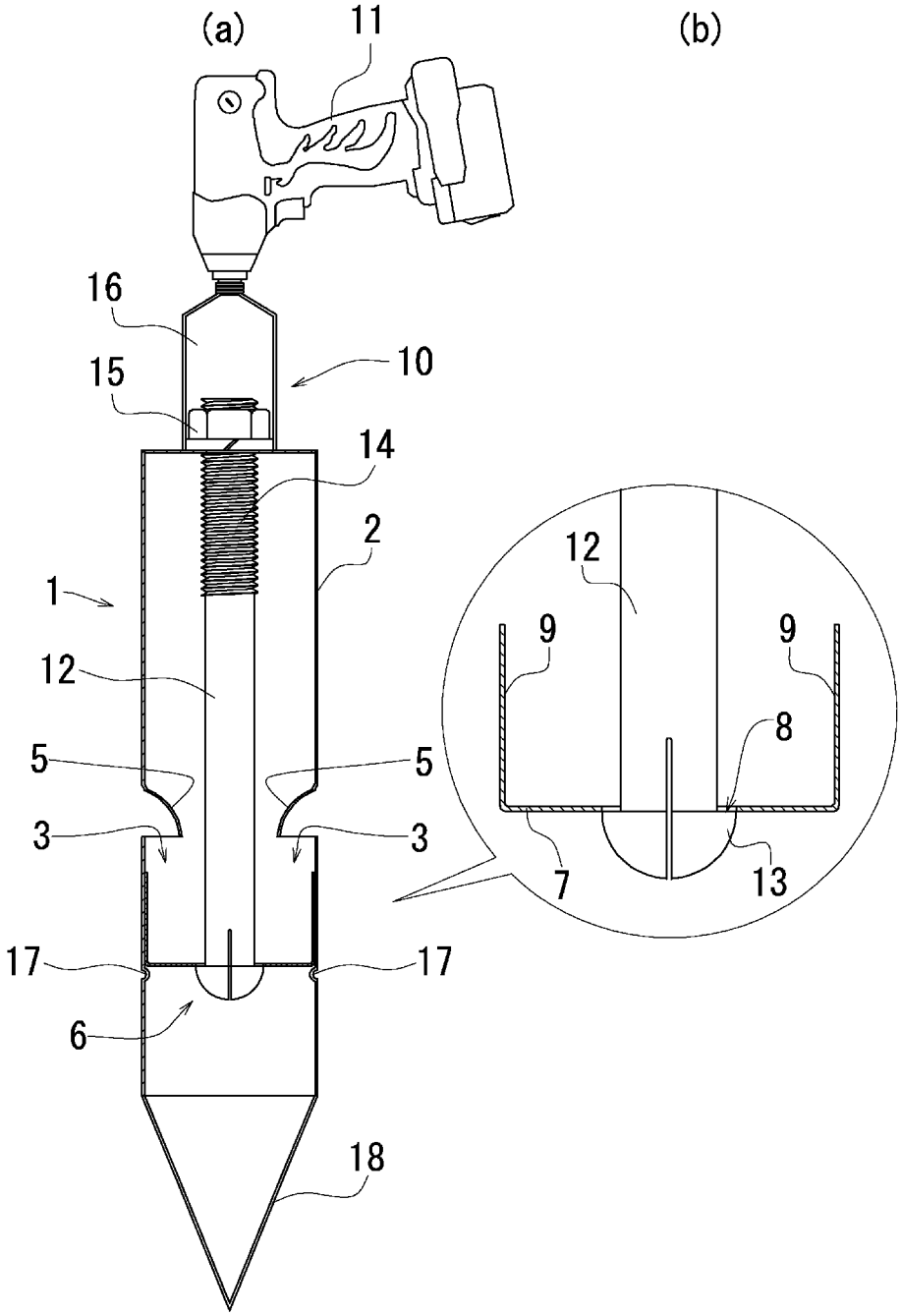
FIG. 4 is a diagram showing a state where the resistance member stored within the pipe is protruded, FIG. 4(*a*) is an overall cross-sectional view and FIG. 4(*b*) is an enlarged view of a main portion of FIG. 4(*a*)

As shown in FIG. 4, the resistance member 6 stored within the pipe 2 is pushed up in the vertical direction with the auxiliary tool 10. The auxiliary tool 10 formed with a push-pull rod 12 and an electric drill 11 which applies a predetermined external force to the push-pull rod 12.

On the one end side of the push-pull rod 12, an engagement end portion 13 is provided which is inserted into the coupling portion 8 of the resistance member 6 to be engaged. On the other hand, on the other end side of the push-pull rod 12, a screw thread 14 is formed, and a hexagon bolt 15 is attached to the screw thread 14. In this state, the electric drill 11 to which a socket wrench 16 is to be fitted to the hexagon bolt 15 is attached and driven in a predetermined direction, and thus the push-pull rod 12 to which the resistance member 6 is coupled is moved upward in the vertical direction.

Here, the auxiliary tool 10 does not always need to be pulled up with the electric drill 11. For example, an operator him/herself may rotate the socket wrench 16.

Moreover, the screw thread 14 does not always need to be formed in the auxiliary tool 10. In this case, in a state where the engagement end portion 13 and the coupling portion 8 are coupled to each other, the operator operates the push-pull rod 12 to pull it up in the vertical direction.

Moreover, the engagement end portion 13 does not always need to be inserted into the coupling portion 8.

For example, when the coupling portion 8 is formed in the shape of a hook, the engagement end portion 13 is preferably also formed in the shape of a hook which is engaged with the hook.

Figure 5:
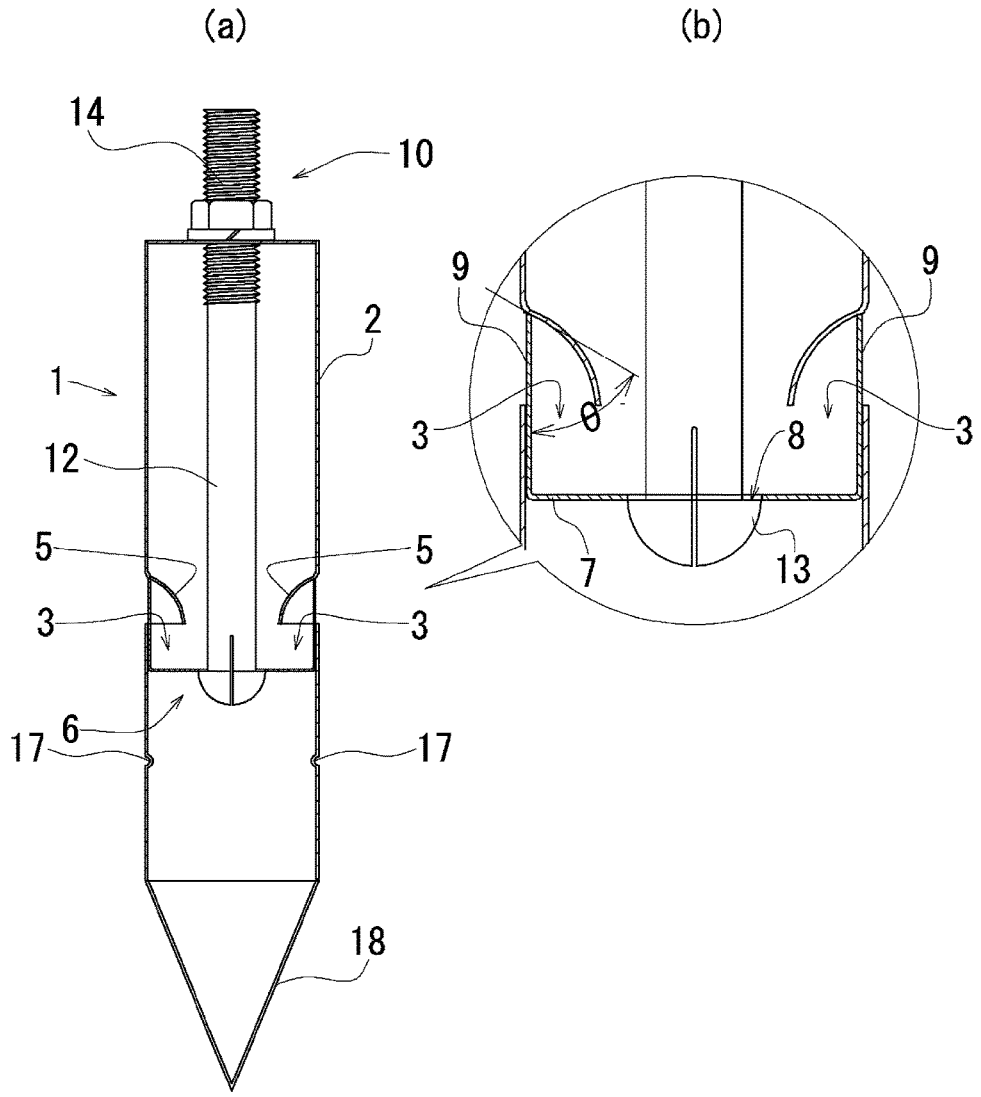
FIG. 5 is a diagram showing a state where the resistance member abuts on guide portions within the pipe, FIG. 5(*a*) is an overall cross-sectional view and FIG. 5(*b*) is an enlarged view of a main portion of FIG. 5(*a*)

As shown in FIG. 5, when the auxiliary tool 10 is used to pull up the resistance member 6 in the vertical direction, the tip end portions of the protrusion portions 9 abut on the guide portions 5. Here, as shown in FIG. 5(*b*), the angle of the guide portion 5 is set such that an angle θ at which the protrusion portion 9 abuts on the guide portion 5 is an acute angle.

Here, the angle θ at which the protrusion portion 9 abuts on the guide portion 5 does not always need to be an acute angle. For example, it may be set to an obtuse angle. However, the angle of the guide portion 5 is set such that the abutting angle θ is an acute angle, and thus the protrusion portion 9 abutting on the guide portion 5 can be reliably guided such that it is deformed so as to be opened and extended toward the outside of the pipe 2.

Figure 6:
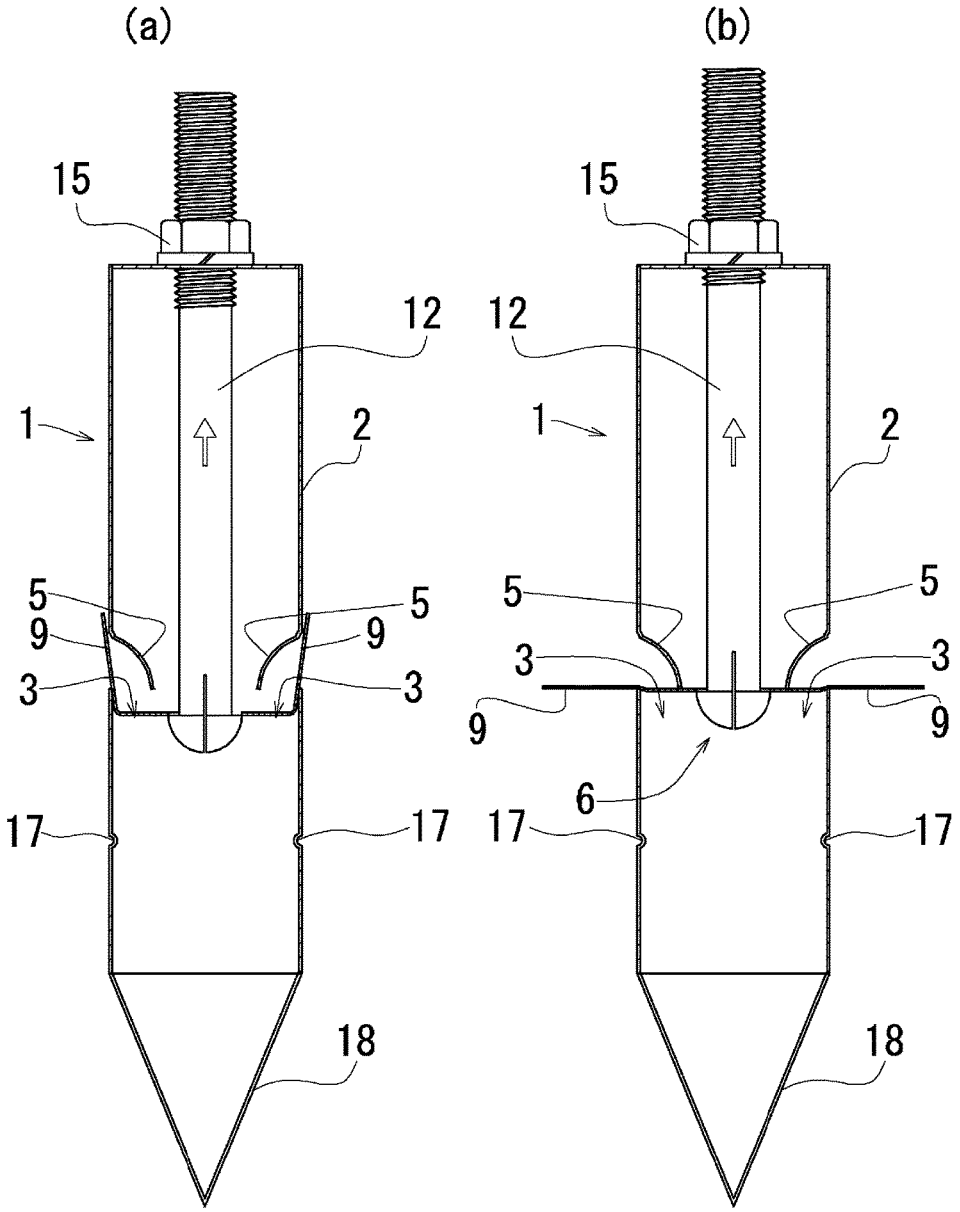
FIG. 6 is an enlarged cross-sectional view of a main portion showing a state where the resistance member is protruded into the ground, FIG. 6(*a*) is a diagram showing a state where the resistance member is coupled to an auxiliary tool and FIG. 6(*b*) is a diagram showing a state where the auxiliary tool is removed from the resistance member.

As shown in FIG. 6(*a*), the auxiliary tool 10 is used to pull up the resistance member 6, and thus the tip and portions of the protrusion portions 9 slide on the guide portions 5 so as to be protruded from the insertion hole portions 3 to the outside of the pipe 2.

As shown in FIG. 6(*b*), the resistance member 6 is further pulled up, and thus the tip ends of the guide portions 5 abut on the base portion 7, the protrusion portions 9 are bent toward the outside of the pipe 2 with the continuously connected portions of the base portion 7 and the protrusion portions 9 serving as the starting points and the protrusion portions 9 are fully protruded to the outside of the pipe 2.

Here, when at least two protrusion portions 9 are formed of the material that can be elastically deformed in the direction in which they are moved away from each other, the protrusion portions 9 can be vigorously protruded from the insertion hole portions 3 toward the outside of the pipe 2, and thus the protrusion portions 9 are vigorously put into the ground, with the result that the resistance member 6 further functions to provide the resistance force in the ground.

Next, a description will be given in a series of construction steps from the installation of the anchor pile 1 according to the present invention in the ground G to the removal thereof.

Figure 7:
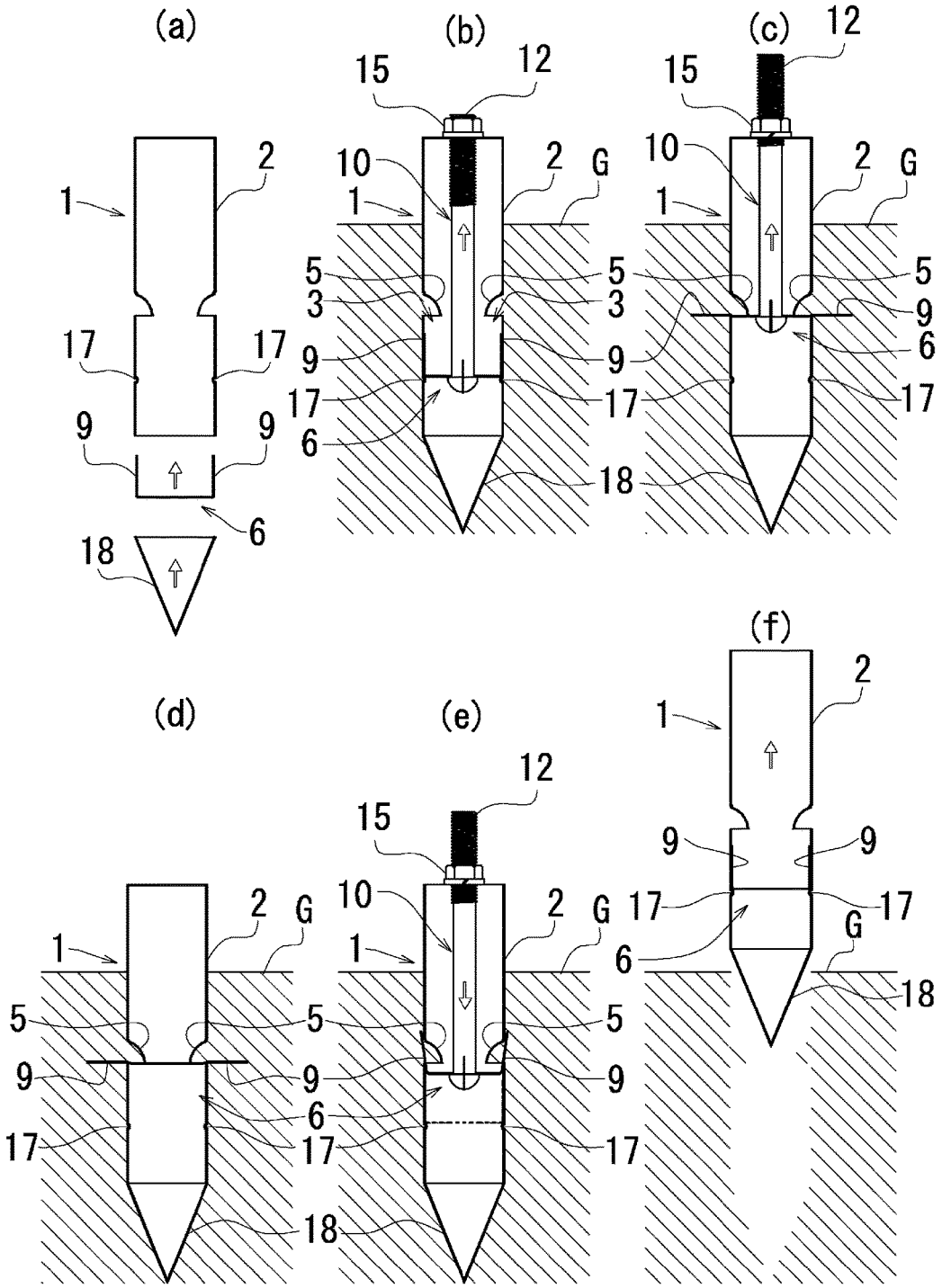
FIG. 7 is a diagram showing a series of construction steps from the installation of the anchor pile in the ground to the pulling out of the anchor pile.

Here, FIG. 7(*a*) is a diagram showing a storage step of storing the resistance member into the pipe, FIG. 7(*b*) is a diagram showing a driving step of driving the anchor pile into the ground, FIG. 7(*c*) is a diagram showing a protrusion step of using the auxiliary tool to protrude the resistance member into the ground, FIG. 7(*d*) is a diagram showing the completion of the installation of the anchor pile in the ground, FIG. 7(*e*) is a diagram showing a storage step of storing the resistance member into the pipe again after the completion of the use of the anchor pile and FIG. 7(*f*) is a diagram showing a pull-out step of pulling out the anchor pile from the ground.

First, as shown in FIG. 7(*a*), the resistance member 6 is inserted from the one end side of the hollow pipe 2, and the ground excavation blade 18 is attached to the one end side of the pipe 2. Next, in a state where the resistance member 6 is stored within the pipe 2, the anchor pile 1 is driven into the ground G. Here, the resistance member 6 is stored within the pipe 2. Hence, no resistance is present when the anchor pile 1 is driven into the ground G, and thus the driving operation is easily performed.

When it is confirmed that the anchor pile 1 is fixed to the ground G after the completion of the driving operation, as shown in FIG. 7(*b*), the auxiliary tool 10 for pulling up the resistance member 6 is coupled to the resistance member 6. Then, as shown in FIG. 7(*c*), the auxiliary tool 10 is operated to pull up the resistance member 6 in the vertical direction within the pipe 2, and thus the protrusion portions 9 are protruded from the interior of the pipe 2 toward the ground G. Finally, as shown in FIG. 7(*d*), the auxiliary tool 10 is removed from the resistance member 6, and the installation of the anchor pile 1 in the ground G is completed.

Next, when the anchor pile 1 installed in the ground G is pulled out from the ground G, as shown in FIG. 7(*e*), the auxiliary tool 10 is first coupled to the resistance member 6. Next, the auxiliary tool 10 is operated to push down the resistance member 6 in the vertical direction within the pipe 2, and thus the resistance member 6 protruded into the ground G is stored into the pipe 2.

When it is confirmed that the resistance member 6 is stored into the pipe 2, as shown in FIG. 7(*f*), the anchor pile 1 is pulled out from the ground G, and the operation of pulling out the anchor pile 1 from the ground G is completed. Here, the resistance member 6 is stored within the pipe 2. Hence, it is possible to reduce an exit resistance force when the anchor pile 1 is pulled out from the ground G, and thus the pull-out operation is easily performed.

Next, anchor piles 1A and 1B according to a second embodiment to which the present invention is applied will be described with reference to FIG. 8. In the following discussion, the substantially same members and the like as the anchor pile 1 of the first embodiment described above are identified with the same reference signs in the figure, and the description thereof will be omitted.

Figure 8:
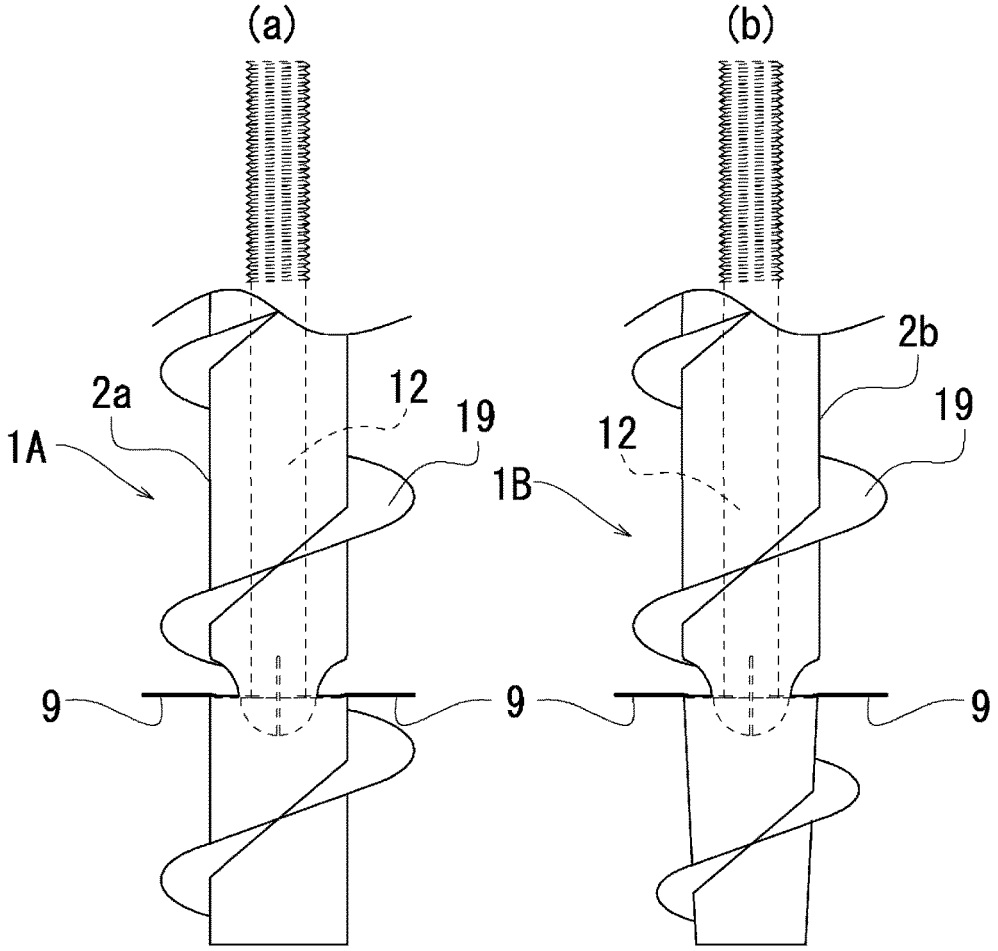
FIG. 8 is a diagram showing an anchor pile according to a second embodiment of the present invention, FIG. 8(*a*) is a diagram in which a spiral member is applied to a straight pipe, FIG. 8(*b*) is diagram in which the spiral member is applied to a tapered pipe.

As shown in FIG. 8(*a*), in the anchor pile 1A, a spiral member 19 in a spiral shape is formed around a pipe 2*a*. In the spiral member 19, as compared with a spiral member 19 in a conventional technology, the width of protrusion is short. In this way, it is possible to reduce an entrance resistance force when the operation of driving the anchor pile 1A is performed, and thus the driving operation is easily performed.

On the other hand, after the anchor pile 1A is driven into the ground, the spiral member 19 and the protrusion portions 9 serve to provide a resistance force in the ground, and thus it is possible to further enhance stability in the ground than in the first embodiment.

In the anchor pile 1B shown in FIG. 8(*b*), as in the anchor pile 1A, the spiral member 19 in a spiral shape is formed around a pipe 2*b*. On the other hand, the pipe 2*b* of the anchor pile 1B has a tapered shape in which the outer diameter thereof is tapered downward. Here, the pipe 2 is formed in the tapered shape, and thus it is possible to reduce an entrance resistance force when the anchor pile 1B is driven into the ground, with the result that as compared with the anchor pile 1A, the driving operation is easily performed.

After the anchor pile 1B is driven into the ground, as in the anchor pile 1A, the spiral member 19 and the protrusion portions 9 serve to provide a resistance force in the ground, and thus it is possible to further enhance stability in the ground than in the first embodiment. Furthermore, it is possible to reduce an exit resistance when the anchor pile 1B is pulled out from the ground, and thus as compared with the anchor pile 1A, the pull-out operation is easily performed Next, anchor piles 1C and 1D according to a third embodiment to which the present invention is applied will be described with reference to FIG. 9. In the following discussion, the substantially same members and the like as the anchor pile 1 of the first embodiment described above are identified with the same reference signs in the figure, and the description thereof will be omitted.

Figure 9:
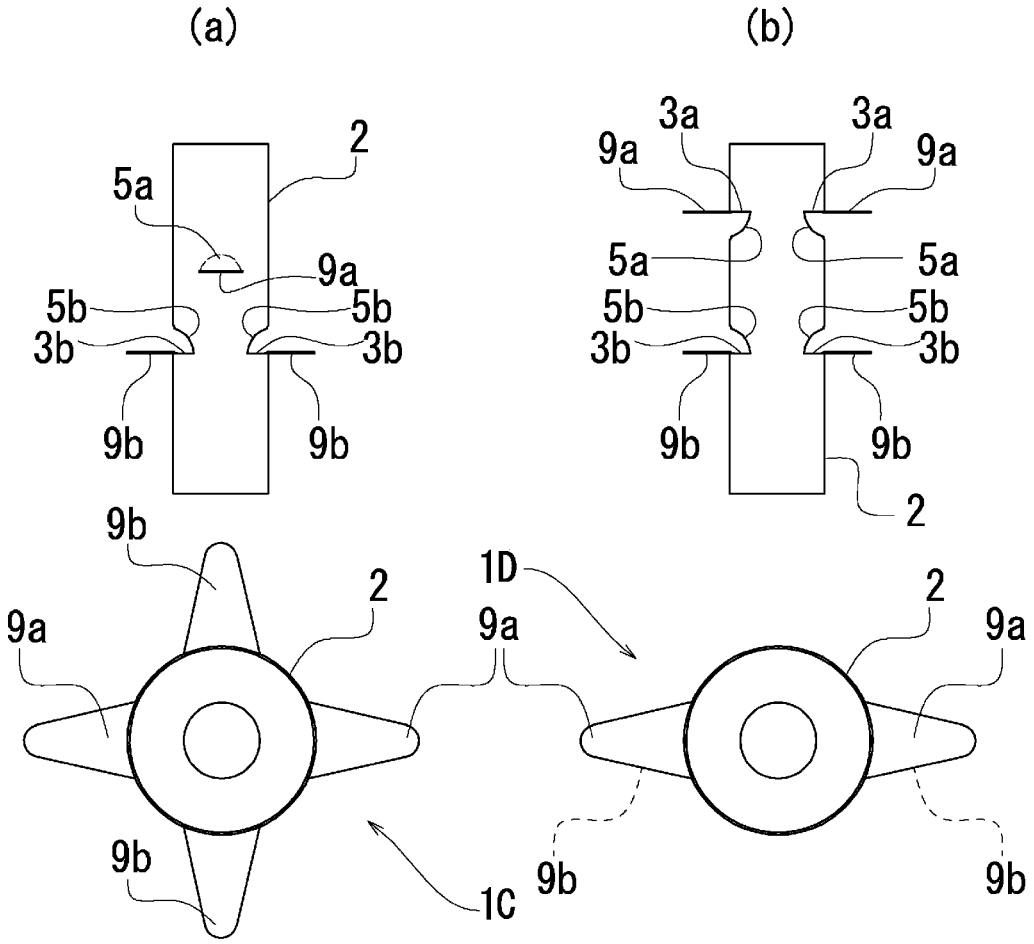
FIG. 9 is a diagram according to a third embodiment of the present invention.

As shown in FIG. 9, the anchor pile 1C and the anchor pile 1D are formed such that an upper resistance member 6*a* and a lower resistance member 6*b* can be arranged on the upper and lower sides of the pipe 2 in a vertical direction. Specifically, as shown in FIG. 9(*a*), in the anchor pile 1C, an upper insertion hole portion 3*a* through which the upper protrusion portion 9*a* of the upper resistance member 6*a* arranged on the upper side of the pipe 2 in the vertical direction can be inserted is formed at two locations which are at about 180 degrees to each other about the center of the center axis of the pipe 2.

On the lower side of the pipe 2 in the vertical direction a predetermined distance apart from the upper insertion hole portion 3*a*, a lower insertion hole portion 3*b* through which the lower protrusion portion 9*b* of the lower resistance member 6*b* can be inserted is formed at two locations which are at about 180 degrees to each other about the center of the center axis of the pipe 2.

The upper insertion hole portion 3*a* and the lower insertion hole portion 3*b* are formed such that the upper resistance member 6*a* and the lower resistance member 6*b* are arranged to intersect each other at about 90 degrees when the pipe 2 is seen in plan view. Hence, the upper protrusion portions 9*a* and the lower protrusion portions 9*b* can be alternately protruded from the side surface of the pipe 2 at equal angles of about 90 degrees about the center of the center axis of the pipe 2. Thus, it is possible to further enhance stability in the ground than in the first embodiment.

Here, the upper resistance member 6*a* and the lower resistance member 6*b* are formed either separately or integrally. When they are formed integrally, for example, in a state where the upper resistance member 6*a* and the lower resistance member 6*b* are coupled together with a coupling member, they are stored at predetermined locations within the pipe 2, the auxiliary tool 10 is used and thus it is possible to move, vertically within the pipe 2, the upper resistance member 6*a* and the lower resistance member 6*b* formed integrally.

Next, as shown in FIG. 9(*b*), in the anchor pile 1D, as in the anchor pile 1C, the upper insertion hole portion 3*a* through which the upper protrusion portion 9*a* of the upper resistance member 6*a* arranged on the upper side of the pipe 2 in the vertical direction can be inserted is formed at two locations which are at about 180 degrees to each other about the center of the center axis of the pipe 2.

On the lower side of the pipe 2 in the vertical direction a predetermined distance apart from the upper insertion hole portion 3*a*, the lower insertion hole portion 3*b* through which the lower protrusion portion 9*b* of the lower resistance member 6*b* can be inserted is formed at two locations which are at about 180 degrees to each other about the center of the center axis of the pipe 2.

Here, the upper insertion hole portions 3*a* and the lower insertion hole portions 3*b* are formed such that the upper protrusion portions 9*a* and the lower protrusion portions 9*b* are protruded from the pipe 2 substantially in the same direction. Hence, the upper protrusion portions 9*a* and the lower protrusion portions 9*b* can be protruded from the side surface of the pipe 2 into the ground in the same direction. Thus, it is possible to further enhance stability in the ground than in the first embodiment.

Here, the upper insertion hole portions 3*a* and the lower insertion hole portions 3*b* do not always need to be formed at locations which are at about 180 degrees to each other about the center of the center axis of the pipe 2. For example, they can also be formed at locations which are about 100 degrees or about 120 degrees to each other.

Next, a method of installing the anchor pile 1C or the anchor pile 1D in the ground G will be described with reference to FIG. 10. Here, the method of installing the anchor pile 1D will be described.

Figure 10:
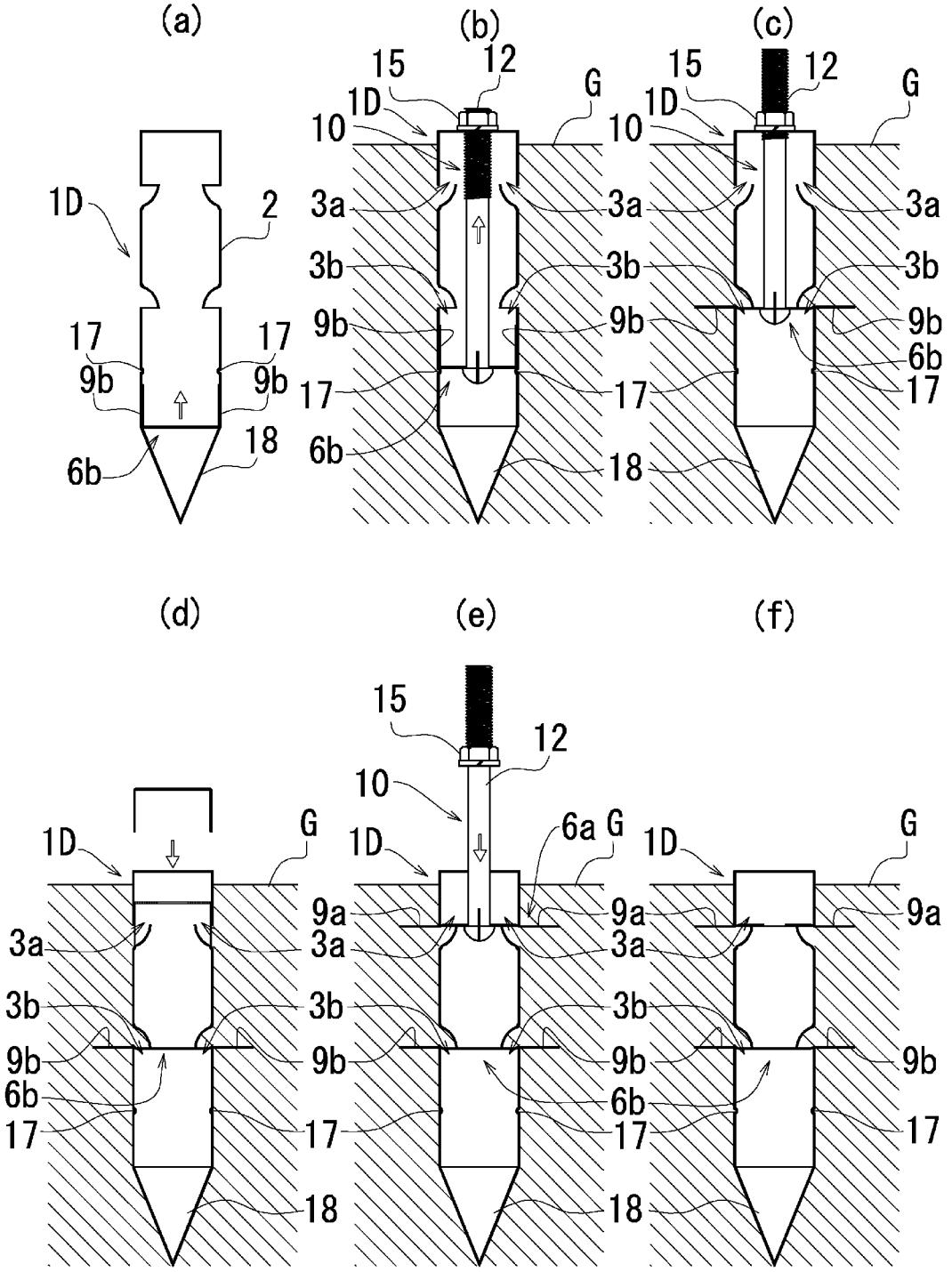
FIG. 10 is a diagram showing an installation method up to the installation of an anchor pile according to the third embodiment of the present invention in the ground.
Figure 11:
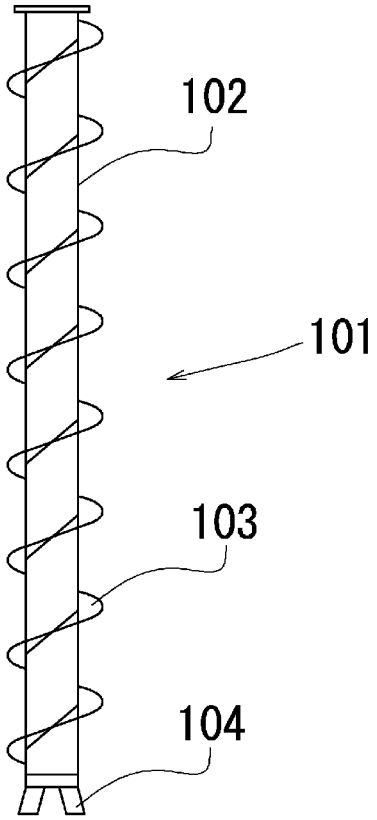
FIG. 11 is a diagram showing a conventional technology.

Here, FIG. 10(*a*) is a diagram showing a storage step of storing the lower resistance member into the pipe, FIG. 10(*b*) is a diagram showing a driving step of driving the anchor pile into the ground, FIG. 10(*c*) is a diagram showing a protrusion step of using the auxiliary tool to protrude the lower resistance member into the ground, FIG. 10(*d*) is a diagram showing a storage step of storing the upper resistance member into the pipe, FIG. 10(*e*) is a diagram showing a protrusion step of using the auxiliary tool to protrude the upper resistance member into the ground and FIG. 10(*f*) is a diagram showing the completion of the installation of the anchor pile in the ground.

First, as shown in FIG. 10(*a*), the lower resistance member 6*b* is inserted from the one end side of the hollow pipe 2 and is stored into the pipe 2. Then, in a state where the lower resistance member 6*b* is stored within the pipe 2, the anchor pile 1D is driven into the ground G.

When it is confirmed that the anchor pile 1D is fixed to the round G after the completion of the driving operation, as shown in FIG. 10(*b*), the auxiliary tool 10 for pulling up the lower resistance member 6*b* is coupled to the lower resistance member 6 *b*.

Next, as shown in FIG. 10(*c*), the auxiliary tool 10 is operated to pull up the lower resistance member 6*a* in the vertical direction within the pipe 2, and thus the lower protrusion portions 9*b* are protruded from the interior of the pipe 2 toward the ground G.

Next, as shown in FIG. 10(*d*), the upper resistance member 6*a* is inserted from the other end side of the pipe 2 and is stored into the pipe 2, and the auxiliary tool 10 is coupled to the upper resistance member 6*a*.

Next, as shown in FIG. 10(*e*), the auxiliary tool 10 is operated to push down the upper resistance member 6*a* in the vertical direction within the pipe 2, and thus the upper protrusion portions 9*a* are protruded from the interior of the pipe 2 toward the ground G.

Last, as shown in FIG. 10(*f*), the auxiliary tool 10 is removed from the upper resistance member 6*a*, and the installation of the anchor pile 1D in the ground G is completed.

In the anchor pile 1C formed separately as well, by the same method, the upper resistance member 6*a* and the lower resistance member 6*b* can be stored into the pipe 2 and protruded toward the ground G.

As described above, in the anchor pile and the method of installing the anchor pile to which the present invention is applied, it is possible to obtain a stable resistance force in the ground while the anchor pile is easily installed.

REFERENCE SIGNS LIST

1, 1A, 1B, 1C, 1D, 101 Anchor pile
2, 102 Pipe
3 Insertion hole portion
3*a* Upper insertion hole portion
3*b* Lower insertion hole portion
4 Concave portion
5 Guide portion
5*a* Upper guide portion
5*b* Lower guide portion
6 Resistance member
6*a* Upper resistance member
6*b* Lower resistance member
7 Base Portion
8 Coupling portion
9 Protrusion portion
9*a* Upper protrusion portion
9*b* Lower Protrusion portion
10 Auxiliary tool
11 Electric drill
12 Push-pull rod
13 Engagement end portion
14 Screw thread
15 Hexagon bolt
16 Socket wrench
17 Stopper portion
18 Ground excavation blade
19, 103 Spiral member
104 Cutting teeth
G Ground

The invention claimed is:

1. An anchor pile comprising:

a hollow pipe in which at least two insertion hole portions are formed on a predetermined location in a side surface of the hollow pipe;

a resistance member which includes at least two protrusion portions and which is stored in the pipe and constructed to move along the pipe by application of a predetermined external force with an auxiliary tool that can perform a push-pull operation on the resistance member; and at least two guide portions which guide the protrusion portions of the resistance member such that the protrusion portions are protruded from the insertion hole portions to an outside of the pipe by the push-pull operation of the auxiliary tool on the resistance member, wherein the guide portions are regions of an outer circumference of the pipe wherein the guide portions are inwardly pressed slits in the side surface of the pipe such that the insertion hole portions are formed, wherein tip end portions of the guide portions and an edge end portion formed on both sides of the insertion hole portions and located in the outer circumference of the pipe wherein the tip end portions and the edge end portions are located substantially on a same straight line when seen in a direction substantially perpendicular to an axial direction of the pipe, wherein within the pipe, in a position in which the resistance member is stored, a stopper portion is provided to prevent further movement of the resistance member, and wherein the stopper portion comprises an inwardly projecting recessed portion of the side surface of the pipe.

2. The anchor pile according to claim 1, wherein an angle between each protrusion portion and the corresponding guide portion is an acute angle when the protrusion portion abuts on the guide portion.

3. The anchor pile according to claim 1, wherein the pipe has a tapered portion in which an outer diameter of the pipe is tapered toward one end side that is driven into a ground.

4. A method of installing the anchor pile according to claim 1, the method comprising the steps of:

driving the pipe into a ground; and applying the predetermined external force to the resistance member with the auxiliary tool and guiding the protrusion portions with the guide portions such that the protrusion portions are protruded from the insertion hole portions to the outside of the pipe.

* * * * *